United States Patent [19]

Robbins et al.

[11] Patent Number: 4,664,599

[45] Date of Patent: May 12, 1987

[54] TWO STAGE TURBINE ROTOR ASSEMBLY

[75] Inventors: Donald A. Robbins, East Windsor Hill, Conn.; William R. Knotek, deceased, late of East Hampton, Conn., by Jeanette H. Knotek, executrix

[73] Assignee: United Technologies Corporation, Hartford, Conn.

[21] Appl. No.: 729,320

[22] Filed: May 1, 1985

[51] Int. Cl.[4] ..... F04D 29/20

[52] U.S. Cl. ..... 416/198 A

[58] Field of Search ..... 415/104, 107, 199.5, 415/198.1; 416/198 R, 198 A, 200 A, 201 R, 244 R, 244 A

[56] References Cited

U.S. PATENT DOCUMENTS

| | | | |
|---|---|---|---|
| 1,288,360 | 12/1918 | Zaar | 415/199.5 |
| 2,652,271 | 9/1953 | Gaubatz | 287/52.05 |
| 2,689,682 | 9/1954 | Boyd et al. | 416/198 A |
| 2,908,518 | 10/1959 | Gregory et al. | 287/52 |
| 2,960,939 | 11/1960 | Buschhorn et al. | 416/198 A |
| 3,222,772 | 12/1965 | Leyner | 29/447 |
| 3,356,339 | 12/1967 | Thomas et al. | 416/198 A |
| 4,004,860 | 1/1977 | Gee | 416/193 A X |
| 4,127,359 | 11/1978 | Stephan | 416/198 A |

FOREIGN PATENT DOCUMENTS

| | | |
|---|---|---|
| 294825 | 2/1954 | Fed. Rep. of Germany . |
| 621418 | 4/1949 | United Kingdom . |
| 715044 | 9/1954 | United Kingdom . |
| 780434 | 7/1957 | United Kingdom . |

*Primary Examiner*—Abraham Hershkovitz
*Assistant Examiner*—John Kwon
*Attorney, Agent, or Firm*—Stephen E. Revis

[57] ABSTRACT

A first turbine rotor hub 32 and a second turbine rotor hub 42 each have respective internal splines 52, 62 which engage coaxial, non-concentric external splines 54, 64 on a shaft 20 and are in thrust bearing relationship. The assembly requires no bolts between the rotor stages 30 and 40 to hold the two stages together. In another embodiment the turbine stages 30, 40 are part of a turbine module 5 which includes a stator assembly 94.

5 Claims, 3 Drawing Figures

TWO STAGE TURBINE ROTOR ASSEMBLY

TECHNICAL FIELD

This invention relates to multi-stage gas turbine engines and particularly to two rotor stage turbine rotor assemblies.

BACKGROUND ART

In twin spool gas turbine engines, working medium gases are compressed within a low pressure compression section and subsequently a high pressure compression section and used as an oxidizing agent in the production of a high temperature effluent. The high temperature effluent is subsequently expanded through a high pressure turbine section and subsequently through a low pressure turbine section. The high pressure turbine drives the high pressure compressor by way of a high pressure shaft and the low pressure compressor is driven by the low pressure turbine by way of a low pressure shaft disposed within the high pressure shaft. Within the turbine section rotor stages attached to the shaft are comprised of a hub, a disk and blades disposed about the peripheries of the disk. The flowpath shape is defined and maintained by a circumferential air seal between the two rotor stages. Blades extend outwardly across the flowpath for working medium gases to extract energy from the gases flowing thereacross. The energy is transmitted to the shaft by way of the disk and hub. High pressure turbines usually comprise two rotor stages with approximately equal amounts of work extracted from each rotor stage. Modern turbofan engines can generate over 60,000 pounds of thrust. The torque transmitted by each rotor stage of the high pressure turbine to the high pressure shaft in a large turbofan engine is approximately 500,000 inch pounds.

A major design goal of complicated turbofan engines is ease of assembly and disassembly while still maintaining structural integrity and limiting the weight of the engine. Limiting the size and weight of the disk portion of the turbine rotor stage while maintaining the structural integrity of the turbine rotor assembly is extremely beneficial. Eliminating holes and flanges for connecting the two turbine rotor stages together is also beneficial for preserving material strength in the face of high centrifugal loads and vibrations.

It is known in the field to attach the two rotor stages of the high pressure turbine together using either bolts or a more permanent means such as welding. It is further known to bolt or weld rotor stages to the shaft. These methods of attaching the two rotor stages to each other results in a gas turbine engine that is more complicated and more difficult to assemble and disassemble than is desired. Furthermore, the use of bolt holes in a disk and the flanges required to attach adjacent rotor stages together requires beefed up disks and heavier rotor stages. Bolt holes reduce the stress capability and structural integrity of the disks. Flanges increase the weight of the rotor stage and contribute to vibration problems that must be designed around. Prior art such as U.S. Pat. No. 3,997,962 to Kleitz et al. entitled "Method and Tool for Removing Turbine from Gas Turbine Twin Spool Engine" teaches the use of a spline to attach the two rotor stages to a single shaft. U.S. Pat. No. 4,004,860 to Gee entitled "Turbine Blade with Configured Stalk" shows the hub of the first rotor stage splined to the shaft, and the hub of the second rotor stage splined to the hub of the first rotor stage so that the shaft, the first rotor stage hub and the second rotor stage hub are all concentric. We have discovered that this type of design has difficulty maintaining concentricity between the hubs and the shaft. This means of attachment causes excessive wear of the splines thereby diminishing structural integrity of the hub to hub and the shaft to hub connections. It is also desired to be able to hold the turbine rotor assembly together so that it can be easily and safely transported for later installation in an engine.

DISCLOSURE OF THE INVENTION

An object of this invention is a two rotor stage turbine rotor assembly which is easily mounted on a shaft, and wherein the rotor stages may be individually or collectively balanced prior to being mounted on the shaft, and wherein the rotor stages can be circumferentially aligned with respect to each other.

Another object of the invention is a turbine module containing rotor and stator assemblies that can be easily disposed on the turbine shaft.

According to the present invention, a gas turbine rotor assembly for mounting on a shaft has a first rotor stage having a first hub and a second rotor stage having a second hub wherein the first and second rotor stages are in thrust bearing relationship, and wherein the first and second hub include, respectively, a first and second means of attachment for mounting the first and second hubs, respectively, to the shaft, wherein the first and second means of attachment are coaxial and non-concentric.

In accordance with one embodiment of the invention, the first and second means of attachment are internal splines on each hub which engage corresponding external splines on the shaft. The internal splines are coaxial and non-concentric. The splines are preferably of equal diameter, but need not be.

A principal feature of the invention is the direct attachment of adjacent hubs to the same shaft, with the rotor stages being in thrust bearing relationship to each other, such as by having the front end of the downstream hub abut the upstream hub. Positioning the first and second hubs in a coaxial non-concentric thrust bearing relationship allows the hubs to be disposed on the engine shaft either individually or as part of an entire rotor assembly, or as part of a turbine module which includes the static structure. If the two disks are to be disposed on the shaft as a unit, such as a rotor assembly or turbine module, means are provided to hold such assembly together as it is installed, such as a fixture or other type of locking apparatus to be further described herein.

A principal advantage of the present invention is the ability to easily mount the individual rotor stages or a two stage rotor disk assembly to the engine shaft while maintaining an effective connection between the rotor stages and the shaft. An additional advantage is to be able to effectively trap and support an interstage seal between the two turbine rotor stages without having to bolt or weld the two rotor stages together. Yet another advantage of the invention is a turbine module, including both rotating and static structure, which is easily and effectively disposed on a shaft.

Other features and advantages will be apparent from the specification and claims and from the accompanying drawings which illustrate an embodiment of the invention.

BEST MODE FOR CARRYING OUT THE INVENTION

Figure 1:
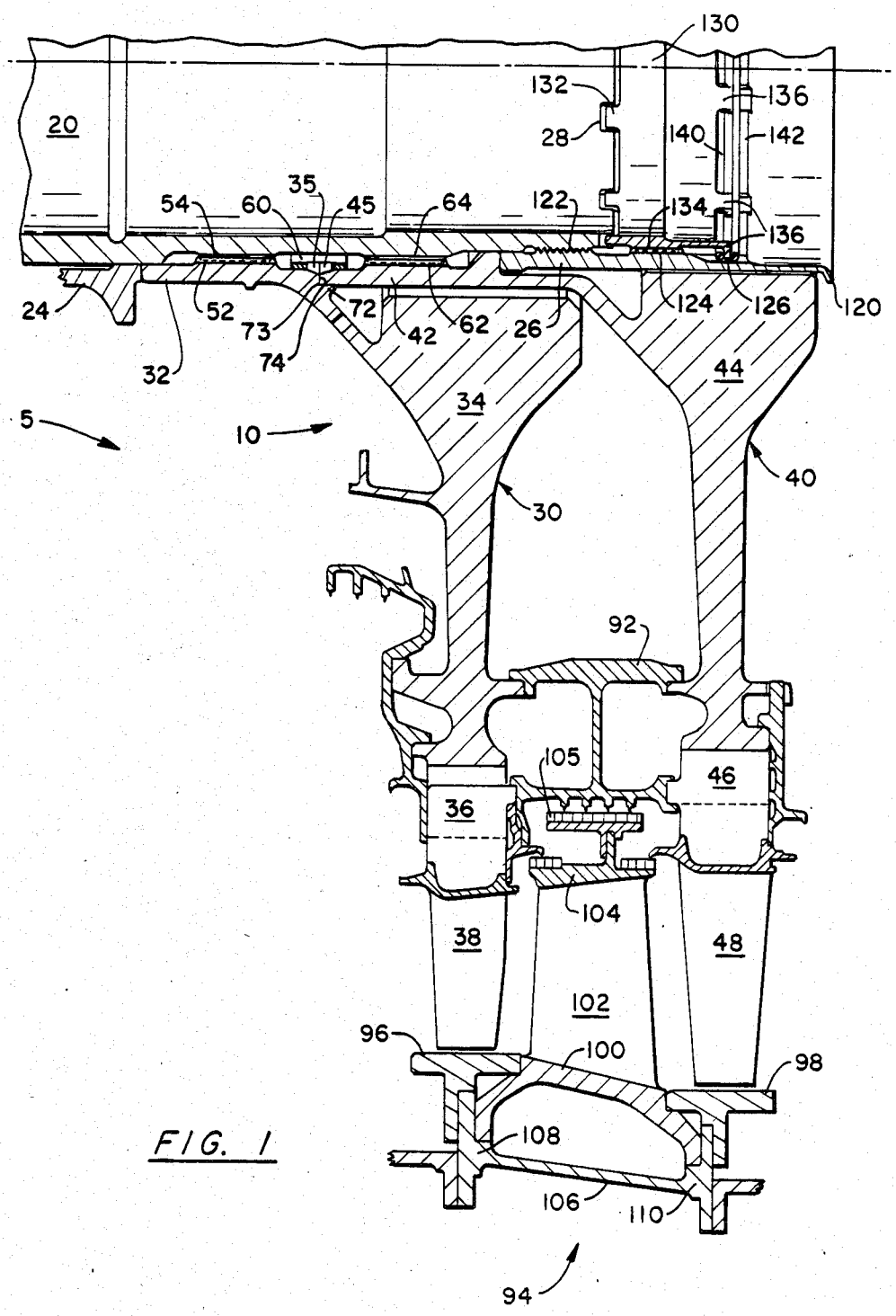
FIG. 1 is a cross-sectional view of a gas turbine engine high turbine section incorporating the features of the present invention.
Figure 2:
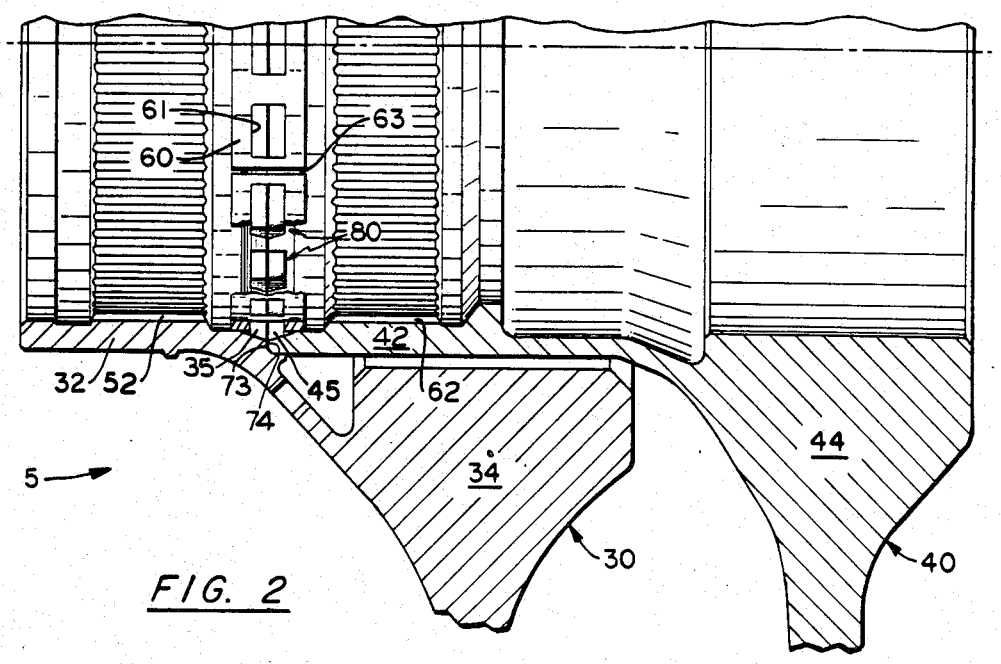
FIG. 2 is a view of part of the high turbine section of FIG. 1 with the turbine shaft removed.

A turbine module 5 constructed according to the present invention is shown mounted on the high rotor shaft 20 of a gas turbine engine in FIG. 1, and is shown separate from the shaft in FIG. 2. The module 5 includes a turbine rotor assembly 10 and a stator assembly 94. The rotor assembly 10 includes a first rotor stage 30 and a second rotor stage 40. The first rotor stage 30 comprises a first hub 32 and a first disk 34 cantilevered off the hub 32. The second rotor stage 40 comprises a second hub 42 spaced radially inwardly from the first disk, and a second disk 44 cantilevered off the hub 42. A first disk rim 36 supports a first plurality of turbine blades 38. A second disk rim 46 supports a second plurality of turbine blades 48. An annular interstage seal 92 is disposed between, is supported radially by, and rotates with the disks 34, 44.

The stator assembly 94 includes a stage of stator vanes 102 disposed between the blades 38 and 48, a first annular outer air seal 96 surrounding the blades 38, and a second annular outer air seal 98 surrounding the blades 48. An inner stator shroud 104 supports a seal land 105 which cooperates with the rotating interstage seal 92. The seals 96, 98 and the vanes 102 are secured by suitable means to a turbine case section 106, which is also part of the stator assembly. More specifically, the first outer air seal 96 and the front end of the outer shroud 100 are attached to a first flange 108 of the turbine case section 106, and the second outer air seal 98 and the rear end of the outer shroud 100 are attached to a second flange 110 of the turbine case section 106.

The turbine blades 38 and 48 extract energy from the working fluid. The energy is transmitted to the shaft 20 by way of the first rotor stage 30 and second rotor stage 40. The shaft 20 has a first external spline 54 and a second external spline 64 which are axially displaced from each other and have the same diameter. The first hub 32 has a first internal spline 52 which is coaxial with and non-concentric to a second internal spline 62 on the second hub 42. The internal splines 52, 62 also have the same diameter. The first internal spline 52 on the first hub 32 engages the first external spline 54 on the shaft 20 for transmitting torque from the first rotor stage to the shaft. The second internal spline 62 on the second hub 42 engages the second external spline 64 on the shaft 20 for transmitting torque from the second rotor stage to the shaft. The large torque transmitted to the shaft 20 by each rotor stage is about 500,000 inch pounds in a large turbofan engine. Because the external splines 54 and 64 are of equal diameter, the hubs 32 and 42 can be easily slid forward onto shaft 20. This also makes machining of the splines on the shaft and on the hubs simpler.

Although preferred, equal diameter splines are not required for this invention. As long as the inside diameter of the first internal spline 52 is as large or larger than the inside diameter of the second internal spline 62, the first and second hubs 32 and 42 can be slid onto shaft 20 individually, or attached to each other as part of a subassembly or turbine module.

A cylindrical ridge 72 forms an annular recess 74 in the rear of first hub 32 to receive the front end 73 of the second hub 42, thereby preventing radial displacement between the first and second hubs. The front end 73 of the hub 42 also bears axially against the hub 32 such that the hubs 32, 42 are in thrust bearing relationship. A nut 120 having internal threads 122 screws onto screw threads 26 located near the rear of the turbine shaft 20 and aft of the second external spline 64. The nut 120 is in thrust bearing relationship with the second hub 42 and is used to tighten up the turbine rotor assembly 10 against a stop 24 which, in this preferred embodiment, is the bearing seal face of a bearing (not shown) located just forward of the turbine. An annular lock 130 has a third external spline 134 which engages a third internal spline 124 on nut 120. The lock 130 also has a plurality of tangs 132 circumferentially disposed about its forward end which engage a plurality of notches 28 in the rear end of shaft 20, thereby preventing the nut 120 and the lock 130 from rotating relative to shaft 20. Lock 130 has a plurality of rear tabs 136 which extend radially outwardly into an interior groove 126 on the nut 120. A first lock ring 140 and second lock ring 142 disposed in the groove 126 on either side of tabs 136 prevent axial displacement of the lock 130.

Figure 3:
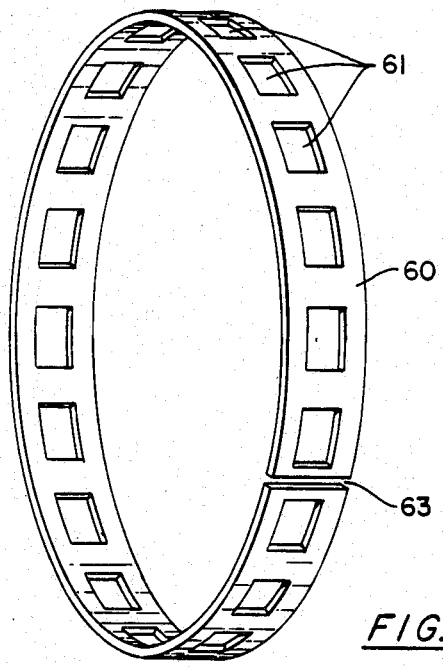
FIG. 3 is a perspective view of a lock ring used to hold the turbine rotor stages together during installation of the rotor assembly in the engine.

Referring to FIGS. 2 and 3, a first plurality of radially inwardly extending lugs 35 are circumferentially disposed about the rear end of the first hub 32 and a second plurality of radially inwardly extending lugs 45 are circumferentially disposed about the front end of the second hub 42. The two sets of lugs are mirror images of and abut each other to define radially inwardly extending projections 80. The sets of lugs 35 and 45 are arranged so that when they align axially, the teeth of the internal splines 52 and 62 also align axially, and the turbine blades 38 and 48 are in the desired circumferential relationship with respect to each other.

If the rotors 30, 40 are to be disposed on the shaft 20 as a unit such as a rotor assembly or a turbine module, or if such rotor assembly or turbine module is to be transported, a ladder lock 60, comprising a resilient metal band having circumferentially disposed rectangular apertures 61 therethrough and a split 63, is used to axially secure the first hub 32 to the second hub 42 for transporting the turbine rotor assembly 10.

The uninstalled diameter of the ladder lock 60 is larger than its desired assembled diameter so that, when in position with the projections 80 extending through the apertures 61, the ring will spring radially outward to rest against the inside diameters of hubs 32 and 42. The projections 80 fit closely within the apertures 61 to prevent any significant relative axial or circumferential movement between the rotor stages 30, 40. The interstage seal 92 is also held tightly in position between the stages.

Once the turbine module 5 is assembled onto the shaft 20 (FIG. 1) the splines 52, 62, nut 120, and lock 130 maintain the proper angular and axial position of the rotor stages 30, 40. The ladder lock 60 therefore serves no operational function during engine operation. It does, however, allow the turbine module 5 to be removed as a unit when servicing the engine.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. A gas turbine engine having a turbine rotor assembly comprising:

a shaft having first and second external non-concentric coaxial splines;

a first rotor stage including a first hub, a first disk, and a first plurality of blades secured to said first disk, said first rotor stage mounted on said shaft, said first disk cantilevered off said first hub, said first hub having a first internal spline engaging said first external spline; and a second rotor stage mounted on said shaft adjacent said first rotor stage, said second rotor stage including a second hub, a second disk, and a second plurality of blades secured to said second disk, said second disk cantilevered off said second hub, said second hub being spaced radially inwardly from said first disk and having a second internal spline engaging said second external spline, said second rotor stage being in thrust bearing realtionship with said first rotor stage.

2. The invention according to claim 1 wherein said first and second splines are axially aligned.

3. The invention according to claim 2, wherein said first hub has an aft end having an annular recess, and said second hub has a front end concentrically disposed within said annular recess, said front end being in thrust bearing relationship with said first hub.

4. The invention according to claim 1 including a plurality of external screw threads disposed on said shaft aft of said external spline, a nut disposed about said shaft engaging said screw threads and in thrust bearing relationship with said second rotor stage, and a locking means engaging said shaft and said nut for preventing rotation of said nut relative to said shaft.

5. The gas turbine engine according to claim 9 including an annular interstage seal disposed between said first and second disks and supported radially and located axially by said first and second disks;

an annular stator stage comprising an inner shroud, an outer shroud, and stator blades disposed between said shrouds, said stator stage disposed radially outward of and in sealing relationship with said interstage seal;

a first outer air seal surrounding said first plurality of blades;

a second outer air seal surrounding said second plurality of blades; and a case surrounding said stator stage, wherein said first outer air seal, said second outer air seal, and said annular stator stage are connected to and supported from said case.

* * * * *

UNITED STATES PATENT AND TRADEMARK OFFICE

CERTIFICATE OF CORRECTION

PATENT NO. : 4,664,599

DATED : May 12, 1987

INVENTOR(S) : DONALD A. ROBBINS and WILLIAM R. KNOTEK (deceased)

It is certified that error appears in the above-identified patent and that said Letters Patent is hereby corrected as shown below:

Column 6, line 13, delete "9" and insert --4--.

Signed and Sealed this

Twenty-fourth Day of January, 1989

*Attest:*

DONALD J. QUIGG

*Attesting Officer*

*Commissioner of Patents and Trademarks*